US005884698A

United States Patent [19]

Hughes et al.

[11] Patent Number: 5,884,698

[45] Date of Patent: Mar. 23, 1999

[54] WHIPSTOCK ASSEMBLY

[75] Inventors: John Hughes, Edmonton; Michael Robert Konopczynski, Calgary, both of Canada

[73] Assignees: Shell Research Limited, United Kingdom; Canadian Fracmaster Limited, Canada

[21] Appl. No.: 765,383

[22] PCT Filed: Jun. 8, 1995

[86] PCT No.: PCT/EP95/02252

§ 371 Date: Apr. 7, 1997

§ 102(e) Date: Apr. 7, 1997

[87] PCT Pub. No.: WO95/33910

PCT Pub. Date: Dec. 14, 1995

[30] Foreign Application Priority Data

Jun. 9, 1994 [EP] European Pat. Off. ..... 94201654
Apr. 12, 1995 [EP] European Pat. Off. ..... 95200929

[51] Int. Cl.[6] ..... F21B 7/08

[52] U.S. Cl. ..... 166/117.6; 175/80; 175/81

[58] Field of Search ..... 175/79, 80, 81; 166/117.5, 117.6

[56] References Cited

U.S. PATENT DOCUMENTS 3,011,568 12/1961 Grimm ..... 166/117.6 X
5,154,231 10/1992 Bailey et al. ..... 175/81 X
5,579,829 12/1996 Comeau et al. ..... 166/117.6

*Primary Examiner*—William Neuder

[57] ABSTRACT

The whipstock assembly comprises an assembly casing (9) with preformed windows connected to production casing (7); a landing tube (21) is located within assembly casing (9) for receiving whipstock shaft; a key is located within tube (21) for cooperation with J-slot on whipstock shaft. The whipstock consists of upper (49) and lower (55) portion which are fixed against relative rotation by splines. The assembly casing (9) with landing tube (21) is positioned in the borehole using a gyro survey tool for correct orientation of the windows. After a first side hole has been drilled, upper portion (49) is raised and rotated to place wedge surface (51) for drilling a second side hole. Tube (21) is initially closed by a cap containing a marking fluid; after the cap has been drilled out the marking fluid indicates the removal of the cap. In a second embodiment two vertically spaced side holes are drilled.

18 Claims, 4 Drawing Sheets

WHIPSTOCK ASSEMBLY

The present invention relates to an assembly for creating borehole branches from a wellbore formed in an earth formation. More particularly the invention relates to an assembly which allows wellbore tools, for example drilling tools or production stimulation tools, to be directed selectively into different deviated borehole branches, and allowing controlled re-entry of the tools.

Whipstocks are commonly used in well drilling in order to deviate the wellbore from an essentially vertical course to a desired inclination. Such whipstocks include tapered sections of round, solid bar which are placed in the wellbore at the desired depth and aligned in the desired direction. They are typically anchored by a slip mechanism, and are used to guide wellbore tools in a selected direction. Generally it is required to mill a window through the casing at the desired kick-off point to permit access to the rock formation around the casing. When only one deviated borehole is drilled, the whipstock is sometimes left in place to act as a guide for re-entry equipment. However, when two or more directional boreholes are drilled from a wellbore it becomes necessary to remove the whipstock from the well so that each of the deviated boreholes can be produced. After removal of the whipstock, selective controlled re-entry into any of the deviated boreholes is difficult and costly since a retrievable whipstock must be placed in the exact position required for re-entry.

It is an object of the invention to provide an assembly for creating deviated borehole branches from a wellbore, which assembly overcomes the aforesaid problems.

In accordance with the invention there is provided an assembly for creating borehole branches from a wellbore formed in an earth formation, comprising a tool guide and positioning means defining a landing position of the tool guide, the positioning means being connected to a casing of the wellbore, the tool guide being positionable at the landing position thereof in at least two different orientations including a first orientation whereby the tool guide guides a tool lowered through the casing in the direction of a first one of said borehole branches and a second orientation whereby the tool guide guides the tool in the direction of a second one of said borehole branches.

The positioning means define an exact landing position for the tool guide, so that repeated positioning of the tool guide in the wellbore at the same position can be achieved without difficulty. The different orientations of the tool guide when in the landing position allow entry of wellbore tools in the different borehole branches. The invention can be used on new wells drilled from surface, or on existing wells which are to be extended.

To create borehole branches of different azimuth angles, suitably the tool guide in the first orientation thereof is oriented in a first angular orientation about the wellbore axis, and the tool guide in the second orientation thereof is oriented in a second angular orientation about the wellbore axis.

Such different angular orientations are suitably achieved if the tool guide includes an upper part and a lower part connectable to said positioning means, the upper part being orientable relative to the lower part in said angular orientations.

Preferably the upper part and the lower part are provided with co-operating splines to facilitate said angular orientations.

To avoid milling windows in the casing to drill the borehole branches, suitably the casing includes at least one window section, each window section being provided with at least one elongated opening, each elongated opening being aligned with one of said borehole branches.

Preferably a removable liner is located inside each window section to temporarily close each opening of the window section during installation of the casing in the wellbore.

The invention will now be described by way of example in more detail with reference to the accompanying drawings in which.

For the purpose of clarity, in the Figures only reference numerals of the main components are indicated, whereby like reference numerals relate to like components.

Figure 1:
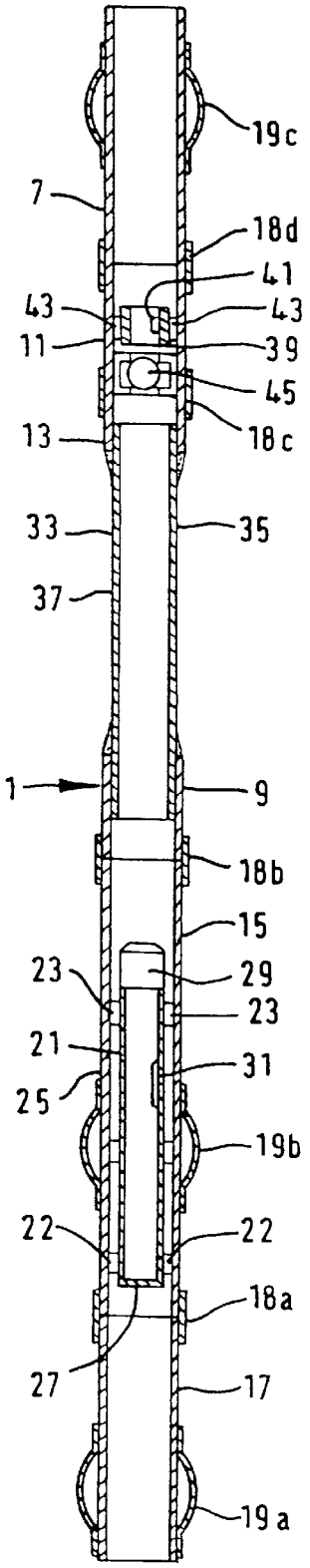
FIG. 1 shows schematically an embodiment of the assembly according to the invention for drilling two opposite borehole branches from a vertical wellbore formed in an earth formation.

Referring to FIGS. 1–4 there is shown a tubular wellbore casing 1 for installation in a wellbore 3 formed in an earth formation 5. The wellbore casing 1 includes an upper part forming production casing 7 and a lower part forming assembly casing 9 extending to near the lower end of the wellbore 3. The assembly casing 9 consists of the following sections in subsequent order in downward direction: a cementing and orienting section 11, a window section 13, a landing section 15, and a casing tail joint 17. The casing tail joint 17 is at its lower provided with a float shoe (not shown) which prevents flow of fluid and debris back into the wellbore casing 1. The various sections 7, 11, 13, 15, 17 are interconnected by conventional casing connectors 18*a*, 18*b*, 18*c*, 18*d* or by other suitable means, and casing stabilisers 19*a*, 19*b*, 19*c* are provided to the casing 1 at regular intervals to centralise the wellbore casing 1 in the wellbore 3.

The landing section 15 is provided with a concentric tube 21 fixed to the inner wall of the landing section 15 by means of spacers 23 in a manner that an annular space 25 is formed between the tube 21 and the inner surface of the casing 1. The tube 21 is closed at its lower end by a bottom 27 fitted with a check valve (not shown) to allow pressure equalisation during cementing operations and to prevent fluid flow out of tube 21. The upper end of the tube 21 is temporarily closed by an aluminium cap 29 which is to be drilled out when a retrievable whipstock described hereinafter is to be installed in the landing section 15. A marker of brightly coloured dye is located in the cap 29, which dye is released upon drilling through the top of the cap 29, circulated to surface with the drilling fluid and made visible at surface to provide an indication of the drilling status. The inner wall of the tube 21 is provided with a key 31 to permit orientation of a retrievable whipstock described hereinafter.

The window section 13 of the casing 1 is provided with two windows in the form of elongated openings 33, 35 oppositely arranged and having their longitudinal axes extending in the longitudinal direction of the window section 13, so that each opening 33, 35 describes the intersection of the casing 1 with one of the deviated borehole branches which is to be drilled through said opening 33, 35. The profile of the windows 33, 35 will therefore vary, depending on the outside diameter of the casing 1, the diameter of the deviated borehole branches, and the build radius of the bend from the wellbore to the deviated borehole branches. The windows 33, 35 are aligned or set at a selected angle with respect to the key 31 of tube 21. A fibreglass liner 37 is internally provided in the window section 13 to temporarily close the elongated windows 33, 35 during installation of the casing 1 in the wellbore 3, thereby preventing fluids from passing through the pre-cut windows 33, 35.

The cementing and orienting section 11 of casing 1 is provided with a tubular element 39 of smaller outer diameter than the inner diameter of the casing 1, which tubular element is internally provided with a key 41 to form a landing profile for an azimuth landing tool (not shown). The key 41 is aligned, or set at a selected angle, with respect to the key 31 in the casing landing section 15.

The tubular element 39 is fixed within the casing section 11 by means of spacers 43. A one-way valve in the form of a float collar 45 is located below the tubular element 39, which float collar 45 allows cement to flow through the casing 1 in downward direction only. All components 39, 41, 43, 45 located within casing section 11 are removable therefrom by the action of a rotating drill bit (not shown) lowered into the casing 1.

Figure 5:
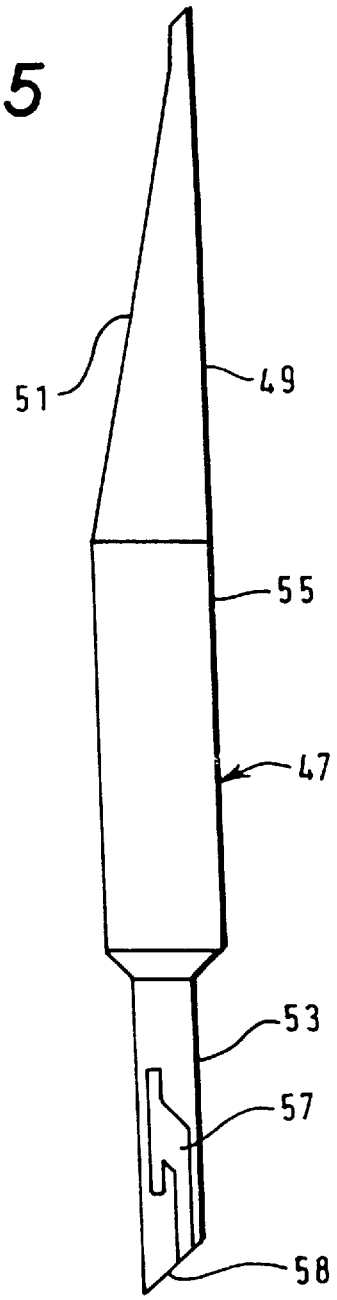
FIG. 5 shows schematically an embodiment of the tool guide used in the assembly of FIGS. 1–4.

In FIG. 5 is shown a tool guide in the form of a retrievable whipstock 47 having an outer diameter slightly smaller than the inner diameter of casing 1. The whipstock 47 consists of an upper part 49 having a tapered concave surface 51 located aside the upper part 49 so as to match drilling tools when these are guided along the surface 51, a lower part in the form of a cylindrical stab element 53 of outer diameter slightly smaller than the inner diameter of the tube 21, and a spacer part 55 located between the upper part 49 and the stab element 53. The stab element 53 is provided with a J-slot keyway 57 which matches key 31 of tube 21 when the stab element is stabbed into the tube 21 after removal of cap 29. The stab element 53 is provided with a guiding surface in the form of a mule shoe 58 to permit self-alignment of the J-slot keyway 57 with key 31. The stab element 53 and the spacer part 55 are provided with corresponding splines (not shown) allowing re-orientation of the spacer part 55 and the upper part 49 relative to the stab element 53 in a manner that the concave surface 51 can be oriented opposite each elongated opening 33, 35 of the window section 13. Slots (not shown) are provided into the upper part 49 of the whipstock 47 for attachment of a retrieving tool (not shown) thereto.

During normal use of the assembly according to the invention, the production casing 7 is set and cemented whereafter the wellbore 3 is drilled or deepened to depth slightly below the desired kick-off point. The assembly casing 9 is then run into the wellbore 3. A gyro survey tool is run into the casing on wireline and landed in the orienting and cementing section 11, and the assembly casing 9 is rotated to orient the windows 33, 35 with the desired azimuth of the deviated boreholes to be drilled, whereafter the gyro survey tool is pulled from the wellbore 3. The assembly casing 9 is cemented in the wellbore 3 by pumping cement 59 down the assembly casing 9 using a conventional wiper plug 60, whereby the cement 59 flows through the annular space 25 formed between the tube 21 and the inner surface of the casing 1. The cement 59 exits the casing 1 at its lower end, and returns back up the annulus between the assembly casing 9 and the wall of the wellbore 3 thereby surrounding the assembly casing 9, including the window section 13.

Figure 2:
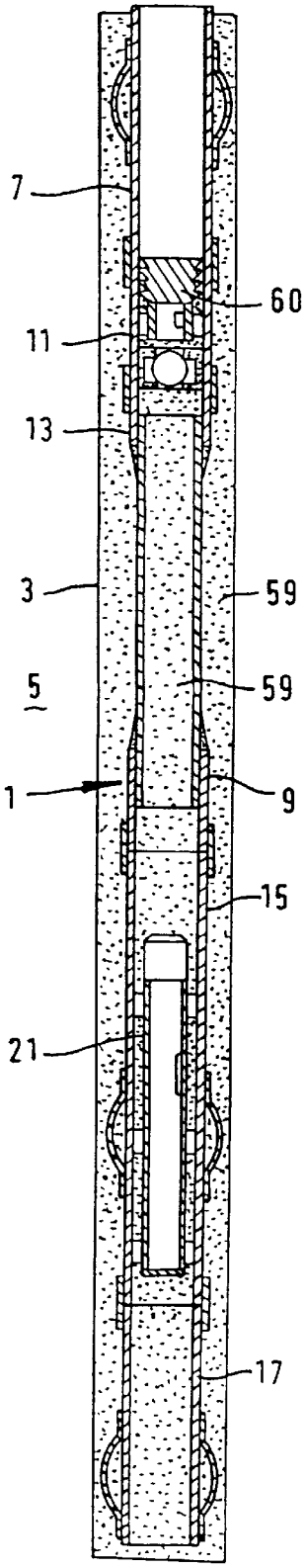
FIG. 2 shows the assembly of FIG. 1 when installed in the wellbore.
Figure 3:
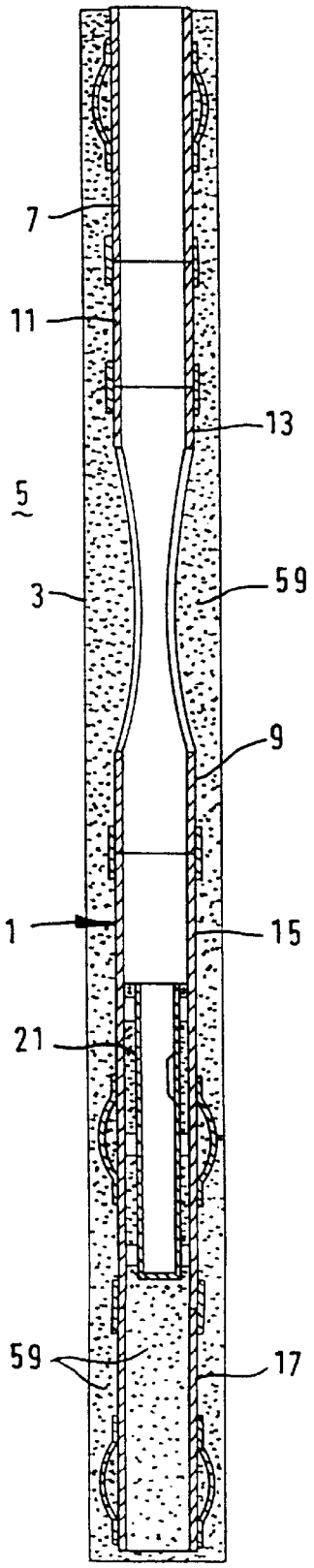
FIG. 3 shows the assembly of FIG. 1 before positioning of a tool guide in the wellbore.

As shown in FIG. 2, the wiper plug 60 lands in the cementing and orienting section 11 above the landing profile, and the float collar 45 prevents back flow of the cement into the casing 1. After allowing the cement to gain compressive strength, a drill string with a drill bit of diameter equal to the inner diameter of the assembly casing 9 is run into the assembly casing 9 and the wiper plug, the landing profile, and float collar are drilled out. Drilling continues through the window section 13 where the fibreglass liner 37 is drilled out, and through the landing section 15 where the aluminium cap 29 is drilled out so that access to the interior of the tube 21 is achieved, reference being made to FIG. 3. Cleaning fluid is then circulated through the drill string and the casing 1 to clean the casing 1, whereafter the drill string is removed from the wellbore 3.

Figure 4:
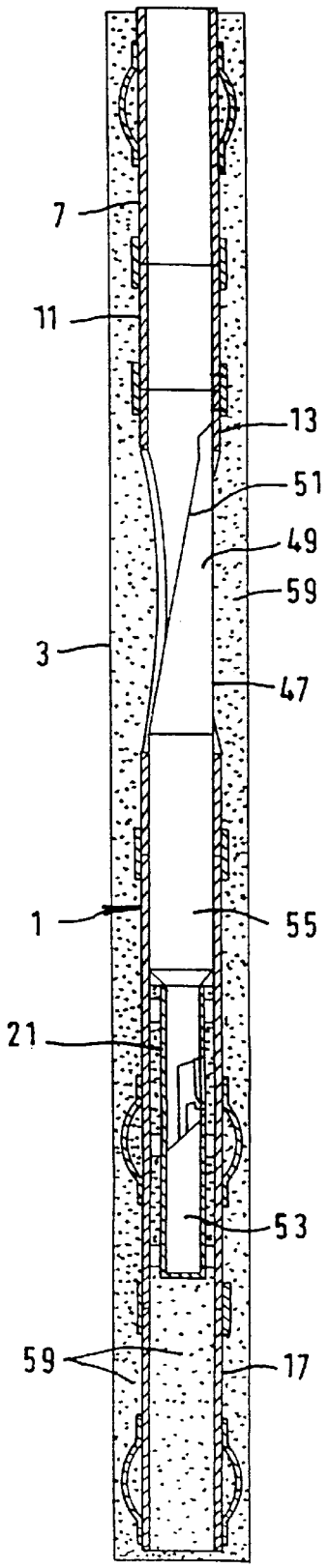
FIG. 4 shows the assembly of FIG. 1 after positioning of the tool guide in the wellbore.

Referring to FIGS. 4 and 5, the retrievable whipstock 47 is then run into the casing 1 and landed in the landing section 15 whereby the stab element 53 of the whipstock 47 is positioned in the tube 21 and the key 31 matches with the J-slot keyway 57. In this position the concave surface 51 of whipstock 47 is arranged opposite a first of the elongated openings 33, 35 of window section 13. Running of the whipstock 47 can be done by wireline, by a drill string using a shear attachment to the drill bit, or by using any other suitable means.

A conventional directional drilling assembly for drilling the build section of the borehole branches is then run into the wellbore 3 whereby the drill bit of the assembly is guided along the concave surface 51 of the whipstock 47 and through a first one of the elongated openings 33, 35. In this manner a first deviated borehole branch is drilled. To re-orient the whipstock 47 in order to drill the second deviated borehole branch, a suitable retrieving tool is latched into the slots in the upper part 49 of the whipstock, and the upper part 49 and the spacer part 55 of the whipstock 47 are pulled from the stab element 53 which remains located in the tube 21. The upper part 49 and the spacer part 55 are then re-oriented relative to the stab element 53 using the splines so that the concave surface 51 of the whipstock 47 is located opposite the second one of the elongated openings 33, 35 of window section 13. The second deviated borehole branch is then drilled whereby the drill bit is guided along the concave surface 51 of the whipstock 47 and through the second one of the elongated opening 33, 35.

Figure 6:
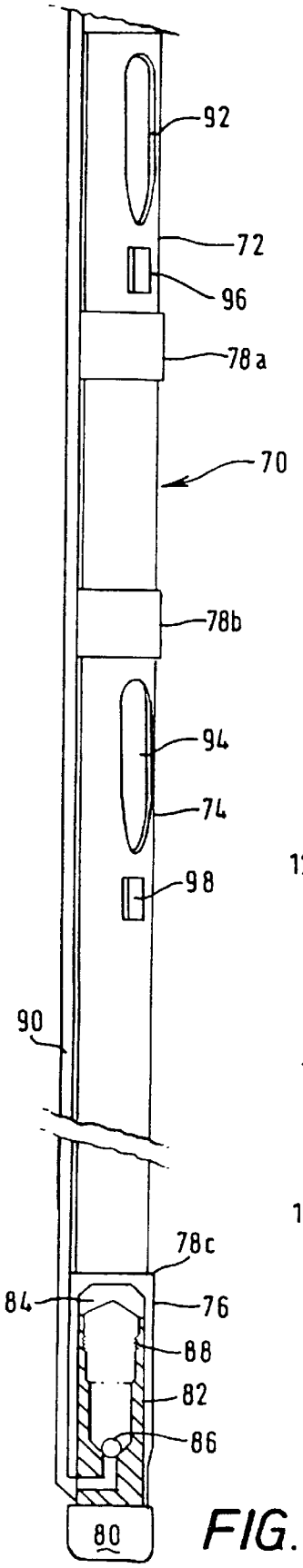
FIG. 6 shows schematically a wellbore casing for use in combination with another embodiment of the assembly according to the invention.

Referring to FIG. 6 there is shown a part of a wellbore casing including a casing assembly 70 having an upper window section 72, an intermediate casing 70, a lower window section 74 and a landing section 76, which sections are interconnected by casing connectors 78*a*, 78*b*. The landing section 76 is at it lower end provided with a guide shoe 80 to guide the casing during lowering thereof in the wellbore.

The landing section 76 is provided with a tube 82 concentrically arranged within the landing section 76, which tube 82 is fixed within the landing section 76 at the lower end thereof. The upper end of the tube 82 is closed by an aluminium cap 84 which is to be drilled out when a retrievable whipstock described hereinafter is to be installed in the landing section 76. The tube 82 is closed at its lower end and provided with a check valve (not shown) to allow pressure equalisation during cementing operations and to prevent fluid flow out of tube 82. The tube 82 is internally provided with a gripping profile 88. Another tube 90 communicates with the check valve 86 and extends along the casing to surface.

The upper window section 72 is provided with an elongate window 92 and the lower window section 74 is provided with an elongate window 94, both windows 92, 94 having their longitudinal axes aligned with the longitudinal direction of the casing. In FIG. 6 the windows 92, 94 are shown aligned so that the borehole branches to be drilled through the windows 92, 94 extend in the same direction. Alternatively each window can be oriented in any desired direction depending on the desired directions of the borehole branches, for example the windows can be oriented in opposite directions or in mutually perpendicular directions. Internal guiding profiles (not shown) and alignment slots 96, 98 are provided in the upper and lower window sections 72, 74 respectively. The internal guiding profiles serve to guide a key of a whipstock (described hereinafter) into the slots 96, 98. The alignment slots 96, 98 are aligned with the respective windows 92, 94. A fibreglass liner (not shown) is internally provided in the window sections 72, 74 to temporarily close the windows 92, 94 during installing and cementing the casing in the wellbore.

Figure 7:
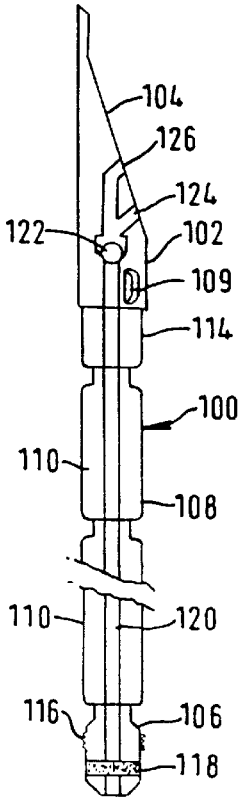
FIG. 7 shows schematically a tool guide in a first mode for use with the wellbore casing of FIG. 6.

In FIG. 7 is shown a drillstring guide in the form of a retrievable whipstock 100 having an outer diameter slightly smaller than the inner diameter of casing. The whipstock 100 consists of an upper part 102 having a tapered concave surface 104 so as to match drilling tools when these are guided therealong, a lower part in the form of a stab element 106 of outer diameter corresponding to the inner diameter of the tube 82, and a spacer part 108 in-between the upper part 102 and the stab element 106. The upper part is provided with a spring-loaded key 109 which during operation co-operates with slot 96 or slot 98. The spacer part 108 is made up of a number of interconnected spacer bars 110 and a swivel 114 which allows the upper part 102 to swivel around the longitudinal axis of the whipstock 100 relative to the stab element 106. The number of spacer bars 110, 112 is selected so that, when the stab element 106 is located in tube 82, the key 109 is latched in slot 98 and the concave surface 104 is located opposite the window 94. The stab element 106 is provided with a gripping profile 116 corresponding to the gripping profile 88 of the tube 82, and a compression packer 118. The lowermost spacer bar 110 is attached to the stab element 106 by a releasable connector (not shown). A longitudinal bore 120 extends through the whipstock 100 to provide fluid communication between the interior of the tube 82 when the stab element 106 is located therein, and the concave surface 104. The bore 120, which is internally provided with a check valve 122, divides into two bores 124, 126 near the concave surface 104.

Figure 8:
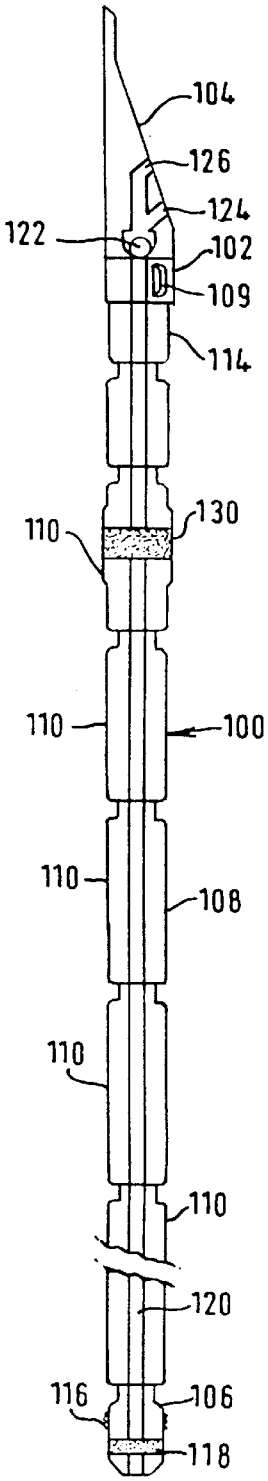
FIG. 8 shows the tool guide in a second mode for use with the wellbore casing of FIG. 6.

During normal use of the assembly shown in FIGS. 6–8, the casing assembly casing 70 is run into the wellbore, oriented in the desired direction and cemented in the wellbore. The cap 84 prevents cement from entering the tube 82. After hardening of the cement, a drill string is lowered into the casing assembly 70 to drill out cement present in the casing assembly and to drill out the fibreglass liner. Drilling continues through the landing section 15 whereby the aluminium cap 84 is drilled out so that access to the interior of the tube 82 is achieved. Cleaning fluid is then circulated through the tube 90 to clean the interior of the tube 82 and the casing assembly 70.

The retrievable whipstock 100 is then run into the casing assembly 70 and landed in the landing section 76 whereby the stab element 106 is latched into the tube 82 and the gripping profiles 88, 116 co-operate to retain the stab element 106 in the tube 82. The key 109 of the whipstock 100 is guided along the guiding profile of window section 74 until the key 109 latches into slot 98. During guiding of the key 109 along the guiding profile, the upper part 102 of the whipstock 100 is allowed to rotate around its longitudinal axis by means of swivel 114. In the final position the concave surface 104 is arranged opposite the window 94. A first borehole branch is then drilled by drilling through the window 94, whereby the drill bit of the assembly is guided along the concave surface 104 of the whipstock 100.

When drilling of a second borehole branch through the upper window 92 is desired, a suitable retrieving tool is latched onto the whipstock 100 whereafter the upper part 102 and the spacer part 108 are pulled from the stab element 106 which remains located in the tube 82. The upper part 102 and the spacer part 108 are retrieved to surface, and one or more spacer bars 110 are added to the spacer part 108, as shown in FIG. 8. The number of spacer bars 110 is selected so that, when the stab element 106 is located in tube 82, the key 109 is latched in slot 96 and the concave surface 104 is located opposite the window 92. The upper part 102 and spacer part 108 are lowered through the casing assembly 70 and re-connected to the stab element 106 by means of the releasable connector, whereby the key 109 is guided along the guiding profile of window section 72 until the key 109 latches into slot 96. Again, the swivel 114 allows rotation of the upper part 102 relative to the stab element 106 during guidance of the key 109 along the guiding profile. In its final position the concave surface 104 is arranged opposite the window 92, whereafter drilling of the second borehole is started through the window 92.

When the whipstock 100 is installed, either with the concave surface 104 opposite window 92 or opposite window 94, cleaning fluid can be circulated through the casing assembly 70 via tube 90 and bores 120, 124, 126 of the whipstock. Check valves 86, 122 prevent undesired flow of drilling fluid through the bores 120, 124, 126 and the tube 90.

Optionally one or more compression packers 130 can be provided at the spacer bars 110 to prevent drilling fluid from flowing to the lower part of the casing assembly 70.

Instead of the arrangement of key and slots as shown in FIGS. 6–8, a J-slot keyway at the stab element and a corresponding key provided at the tube, or a J-slot keyway at the tube and a corresponding key provided at the stab element, can be applied. In such alternative arrangements there would be no need for a swivel at the whipstock. The absence of a key at the inner surface of the tube allows drilling through the tube whereby the bottom of the tube is drilled out, and subsequent drilling through the bottom of the casing tail joint in order to drill a lower borehole section either straight or inclined, in a conventional manner.

Access to either of the deviated borehole branches for future remedial work can be accomplished by re-running the retrievable whipstock in the desired position or orientation.

The entire assembly, including the retrievable whipstock, can be constructed from non-magnetic materials to permit the use of conventional magnetic directional survey instruments in the drilling assembly for the purpose of orienting the drilling assembly upon exiting the windows for drilling the build sections. In the above described embodiments the assembly has two windows for drilling of two borehole branches. Alternatively the assembly can be provided with any suitable number of windows to drill a corresponding number of deviated borehole branches.

Instead of the marker of brightly coloured dye, any suitable marker can be provided which is released upon drilling therethrough and which forms a detectable part of the drilling fluid circulated to surface so as to provide an indication of the status of drilling through the assembly. Furthermore, other parts of the assembly can in a similar manner be provided with a marker, for example in the cementing and orienting section, or in the window section.

We claim:

1. Assembly for creating borehole branches from a wellbore formed in an earth formation, comprising a tool guide and positioning means defining a landing position of the tool guide, the positioning means being connected to a casing of the wellbore, the tool guide being positionable at the landing position thereof in at least two different orientations including a first orientation whereby the tool guide guides a tool lowered through the casing in the direction of a first one of said borehole branches and a second orientation whereby the tool guide guides the tool in the direction of a second one of said borehole branches;

wherein said positioning means includes a tube arranged substantially concentrically within the casing, and the tool guide includes a stab element to be received in said tube when the tool guide is in the landing position, and the tube is provided with removable sealing means to seal the interior of the tube from the interior of the casing during installation of the casing in the wellbore.

2. The assembly of claim 1, wherein the tool guide in the first orientation thereof is oriented in a first angular orientation about the wellbore axis, and the tool guide in the second orientation thereof is oriented in a second angular orientation about the wellbore axis.

3. The assembly of claim 2, wherein the tool guide includes an upper part and a lower part connectable to said positioning means, the upper part being orientable relative to the lower part in said angular orientations.

4. The assembly of claim 3, wherein the upper part and the lower part are provided with co-operating splines to facilitate said angular orientations.

5. The assembly of claim 3, wherein the tool guide includes a swivel allowing rotation of the upper part of the tool guide relative to the lower part thereof about the longitudinal axis of the tool guide.

6. The assembly of claim 1, wherein said borehole branches deviate from the wellbore at different levels thereof, wherein the tool guide is operable in a first mode and a second mode in which the tool guide is longer than in the first mode, the difference in length of the tool guide in said two modes corresponding to the difference in levels of the said borehole branches.

7. The assembly of claim 6, wherein the tool guide includes a spacer part which comprises at least one spacer bar, the number of spacer bars being selected in accordance with the length of the tool guide.

8. The assembly of claim 1, wherein the sealing means forms a cap covering the upper end of the tube.

9. The assembly of claim 1, wherein said sealing means is removable from the tube by the action of a rotating drill bit lowered through the casing.

10. The assembly of claim 9, wherein the tube is provided with marking means which is released upon drilling away the sealing means, the marking means flowing with the drilling fluid to the surface so as to provide an indication of removal of the sealing means.

11. The assembly of claim 1, wherein an orientation keyway is provided at the inner surface of the tube, said keyway co-operating with an orientation key provided at the stab element so as to orient the tool guide when the tool guide is brought in the landing position.

12. The assembly of claim 1, wherein said tube is filled with a lubricant to promote stabbing of the stab element into the tube.

13. The assembly of claim 1, wherein the casing includes at least one window section, each window section being provided with at least one elongated opening, each elongated opening being aligned with one of said borehole branches.

14. The assembly of claim 13, wherein a removable liner is located inside each window section to temporarily close each opening of the window section during installation of the casing in the wellbore.

15. The assembly of claim 13, wherein the casing includes an orienting section provided with means for landing an azimuth survey tool therein, which tool has a selected orientation relative to the elongated openings of the window section when the tool is landed in the orienting section.

16. Assembly for creating borehole branches from a wellbore formed in an earth formation, comprising a tool guide and positioning means defining a landing position of the tool guide, the positioning means being connected to a casing of the wellbore, the tool guide being positionable at the landing position thereof in at least two different orientations including a first orientation whereby the tool guide guides a tool lowered through the casing in the direction of a first one of said borehole branches and a second orientation whereby the tool guide guides the tool in the direction of a second one of said borehole branches and wherein the tool guide in the first orientation thereof is oriented in a first angular orientation about the wellbore axis, and the tool guide in the second orientation thereof is oriented in a second angular orientation about the wellbore axis, and the tool guide includes an upper part and a lower part connectable to said positioning means, the upper part being orientable relative to the lower part in said angular orientations, and wherein the upper part and the lower part are provided with co-operating splines to facilitate said angular orientations.

17. Assembly for creating borehole branches from a wellbore formed in an earth formation, comprising a tool guide and positioning means defining a landing position of the tool guide, the positioning means being connected to a casing of the wellbore, the tool guide being positionable at the landing position thereof in at least two different orientations including a first orientation whereby the tool guide guides a tool lowered through the casing in the direction of a first one of said borehole branches and a second orientation whereby the tool guide guides the tool in the direction of a second one of said borehole branches, said borehole branches deviating from the wellbore at different levels thereof, wherein the tool guide is operable in a first mode and a second mode in which the tool guide is longer than in the first mode, the difference in length of the tool guide in said two modes corresponding to the difference in levels of the said borehole branches.

18. The assembly of claim 17 wherein the tool guide includes a spacer part which comprises at least one spacer bar, the number of spacer bars being selected in accordance with the length of the tool guide.

* * * * *